US005161800A

United States Patent [19]

Parsons et al.

[11] Patent Number: 5,161,800

[45] Date of Patent: Nov. 10, 1992

[54] RETAINER CLIP FOR EXPANDING BATON

[75] Inventors: Kevin Parsons; Jerome J. Weber, both of Appleton, Wis.

[73] Assignee: Armament Systems and Procedures, Inc., Appleton, Wis.

[21] Appl. No.: 746,467

[22] Filed: Aug. 16, 1991

[51] Int. Cl.[5] ..... F41B 15/02

[52] U.S. Cl. ..... 273/84 R; 70/456 R

[58] Field of Search ..... 273/84 R, 84 ES, 32 F, 273/80 D, 68; 30/162, 163; 135/75, 107; 403/109, 329, 361

[56] References Cited

U.S. PATENT DOCUMENTS 1,935,560 11/1933 Herold ..... 403/329

2,488,849 11/1949 Churchill ..... 403/329

4,752,072 6/1988 Parsons ..... 273/84 R

FOREIGN PATENT DOCUMENTS 0360005 3/1990 European Pat. Off. ..... 273/84 R

*Primary Examiner*—William H. Grieb

*Assistant Examiner*—William M. Pierce

*Attorney, Agent, or Firm*—Andrus, Sceales, Starke & Sawall

[57] ABSTRACT

In an expandable baton having a barrel and a telescoping member carried in the barrel and movable between extended and retracted positions, a spring clip retainer includes tapered outer ends and rounded edges for engaging and retaining the telescoping member in the retracted position without snagging or gouging the telescoping member as it is retracted.

4 Claims, 1 Drawing Sheet

D
M
2/3D
1/3D

RETAINER CLIP FOR EXPANDING BATON

BACKGROUND OF THE INVENTION

1. Field of the Invention

The subject invention is generally related to passive self-defense weapons such as expandable self-defense key chains, and is specifically directed to a retainer clip for an expanding baton-type weapon.

2. Description of the Prior Art

Self-defense key chains are used primarily by civilians to defend against physical attack. Because this self-defense instrument also serves as a key chain, it is usually carried on the person of its owner and is, therefore, readily available.

As disclosed in my earlier U.S. Pat. No. 4,752,072, entitled: "Telescoping Self-Defense Key Chain," issued Jan. 21, 1988, there are five basic modes in which self-defense key chains can be used as weapons. First, the handle may be grasped to deliver a striking, swinging blow with the key ring end. Secondly, the keys attached to the key ring may be grasped to strike a swinging blow with the handle. Thirdly, the handle may be grasped to deliver either a forehand or a backhand jabbing blow with the butt or tip of the handle. In addition, a pressure grip may be applied by placing the side of the handle across the sensitive area, usually the wrist, of an adversary and squeezed to inflict pain compliance. Finally, the butt or tip end of the handle may be used for pain compliance, for example when applied in the pectoral region.

Typically a telescoping self-defense key chain includes a handle with the key ring attached at one end. The telescoping member is slidably disposed within the handle. In the retracted position, the telescoping self-defense key chain functions as both a key chain and as a self-defense weapon for pressure holds or for striking blows at close range. The telescoping member may also be extended and locked in position to increase the overall length of the key chain.

Telescoping self-defense key chains of the prior art include spring biased clip retainers for holding the expandable section of the baton in the handle during normal use. While this has been an effective and useful assembly for the self-defense key chain, it has been found that the retainer clip could be improved to facilitate the manufacturing and assembly of the expanding baton and to enhance the durability and repeatability of the retainer in the final product.

SUMMARY OF THE INVENTION

The telescoping self-defense key chain of the present invention includes an outer barrel or handle formed from a hollow tube and an inner telescoping member which is adapted to be received by the hollow handle and retained therein in normal use. A spring clip retainer is disposed in one end of the hollow handle and is adapted to engage and hold the telescoping member in the retracted position. In the subject invention, the spring retainer is designed to maximize the bow of the spring to provide better retaining capability and to minimize the probability of distortion and deformation of the spring upon repeated uses. The ends of the retainer are tapered and the edges of the spring sections are rounded to eliminate snag points which could have a detrimental effect on the function of the key chain. The outer tips of the bowed spring retainer are in abutting relationship with one another to provide a more uniform action between the spring retainer and the expanding portion of the baton, resulting in a more uniform retaining force.

It is, therefore, an object and feature of the subject invention to provide for a telescoping self-defense key chain having an expandable baton with an improved retainer clip for providing a more uniform and more durable retainer for holding the expandable portion of the baton in the barrel or handle of the baton during normal use.

It is also an object and feature of the subject invention to provide for a retainer clip which is not subject to snagging or breaking during use.

It is a further object and feature of the subject invention to provide a retainer clip for holding an expandable portion of a baton in the barrel or handle of the baton with a more uniform retaining force.

Other objects and features of the invention will be readily apparent from the drawing and detailed description of the preferred embodiment, which follow.

DETAILED DESCRIPTION OF THE PREFERRED EMBODIMENT

Figures 1, 2, 3, 4, 5, 6:
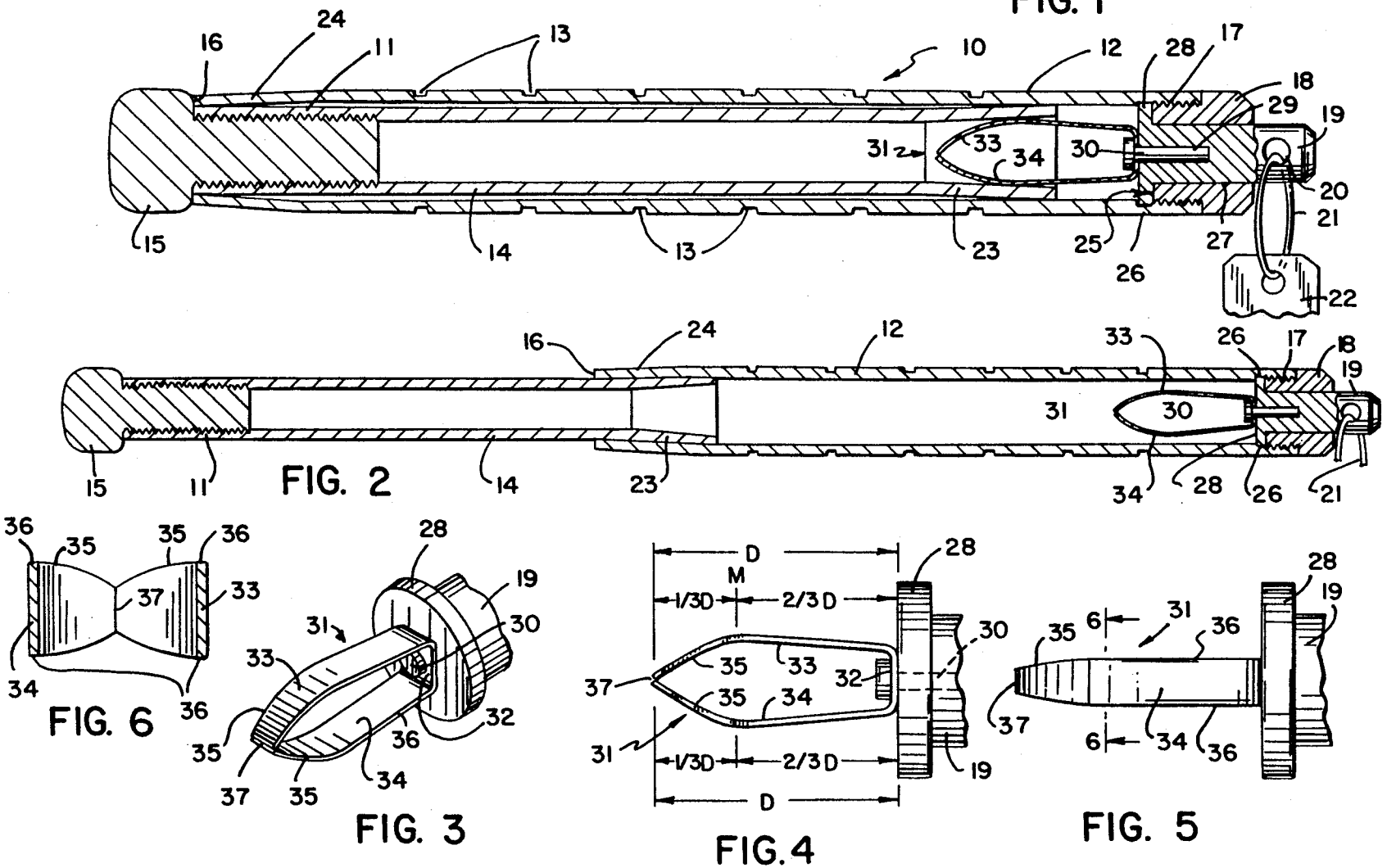
FIG. 1 is a sectional plan view of a telescoping key chain incorporating a retainer clip in accordance with the present invention, showing the expandable portion of the key chain in the retracted position.
FIG. 2 is a sectional plan view similar to FIG. 1, showing the baton of the key chain in the fully extended position.
FIG. 3 is a perspective view of the retainer clip of the key chain in FIG. 1.
FIG. 4 is a side plan view of the retainer clip of FIG. 3.
FIG. 5 is a side plan view of the retainer clip rotated 90° from FIG. 4.
FIG. 6 is a section view taken generally along lines 6—6 of FIG. 5.

An expandable baton with a retainer clip in accordance with the subject invention is shown in FIG. 1, as used in conjunction with a self-defense key chain holder 10. The key chain holder 10 includes a barrel or handle 12 formed from a hollow tube. In the preferred embodiment, the handle 12 is provided with a series of axial grooves 13 spaced along the length of the handle to provide a gripping surface during use. The telescoping member 14 is disposed within the handle 12. One end 11 of the telescoping member is tapped to receive a threaded tip 15. The tip 15 is a solid material such as aluminum or the like and includes rounded corners, permitting use of the baton as a weapon without inflicting serious or permanent injury. In the retracted position of FIG. 1, the tip 15 abuts with the outer end 16 of the handle 12. The opposite open end of the handle 12 is tapped as at 17 to receive an end cap 18. The end cap 18 includes a central bore adapted for receiving a key ring swivel 19. The swivel 19 includes a through hole 20 for receiving a key ring 21 adapted for receiving and retaining one or more keys 22.

The telescoping portion 14 of the baton is free to slide within the handle 12 until the flared end 23 contacts the swaged outer end 24 of the barrel. The tapers of the swage on the handle 12 and the flare on the telescoping portion 14 are approximately the same, so that when contact is made between the flared end of the telescoping portion 14 and the barrel 12, the telescoping portion is securely wedged into its extended position in the swaged end of the handle. The wedge so formed is sufficiently strong that it will not be broken free by a jabbing blow or by axial pressure on a subject. The telescoping member is retracted back into the barrel by making a sharp axial strike on the tip 15 of the baton against a hard solid surface such as a concrete wall or pavement.

A more detailed description of a baton type key chain incorporating the barrel, telescoping member and key swivel as described herein is more fully shown and described in my aforementioned U.S. Pat. No. 4,752,072, incorporated by reference herein.

In accordance with the subject invention, the end cap 18 of the key ring has an inner wall or end 25. Adjacent the wall 25 and disposed about the inner surface of handle 12 is an annular channel or groove 26. An axial bore 27 is provided in the cap 19 for receiving the swivel 19. The swivel 19 includes an enlarged circular base 28 adapted to be placed in abutting relationship with cap end wall 25 and to fit within channel 26. This retains the swivel in the assembly when the cap is screwed into the handle. The swivel is free to rotate in the channel 26 and bore 27. A mounting hole 29 is provided in the base 28 and is adapted to receive and engage a retaining post 30.

The retainer spring 31 includes a base 32 and two opposed legs 33, 34. The base 32 includes a central mounting hole for receiving post 30, whereby the enlarged head of the post retains the spring in assembled relationship with the swivel 19.

As is particularly shown in FIGS. 5 and 6, the spring clip 31 of the subject invention includes spring legs 33 and 34 each terminating in a tapered outer end 35. The tapered outer end assures that the flared end 23 of the extension member 14 of the baton will not snag on the spring clip as it is retracted into the baton. This is particularly important since the extension member can only be dislodged from the extended, locked position by striking a sharp axial blow against the tip 15. When blunt ended springs are utilized, it is possible for inner surface of the flared end 22 of the extension member to engage a corner of the spring leg and damage the flared end of the extension member or break a portion of the spring. To further reduce the potential for snagging or scoring damage to the flared end of the extension member, the outside edges 36 of the spring retainer legs 33 and 34 are rounded with a radius surface to eliminate sharp edges which may engage and gouge the flared end of the extension member. By removing this tendency of the spring to engage or "grab" the walls of the baton, a smoother sliding action is assured. Also, the spring legs act more uniformly throughout the life of the product.

In order to provide a more uniform retaining force and to assure consistent retaining capability, the legs 33 and 34 are dimensioned such that the maximum point M of the bow spring is approximately $\frac{2}{3}$ of the distance D from the base 32 of the spring to its outer tips 37. This assures that the maximum expanded portion of the opposed spring legs are sufficiently disposed along the axis of the barrel to assure solid engagement with the flared end of the extension member when it is retracted into the barrel of the baton. When assembled, the outer tips 37 of the legs 33 and 34 are in abutting relationship with one another, to assure that one leg of the spring does not move further inward toward the center axis of the baton during assembly, thereby assuring a uniform retention force by both legs of the spring during use.

While certain objects and features of the invention have been described herein, it will be understood that the invention incorporates all enhancements and modifications within the scope and spirit of the appended claims.

We claim:

1. In an expandable baton of the type having an elongated cylindrical handle with a longitudinal axis including a hollow cylindrical cavity with an opening on one end and closed at the other end, and a telescoping member disposed in the cavity, the telescoping member being movable between an axially retracted position and an extended position, an improved retaining means for holding the telescoping member in the retracted position, the improvement comprising:

a. a leaf spring having a base mounted in the closed end of the handle and having a pair of opposed bowed legs extending generally axially from the closed end toward the open end of the handle, the legs of the leaf spring being adapted for engaging the telescoping member, each of said legs having a predetermined width along a substantial portion of their length and including an outer end toward the open end of the handle which is tapered to a smaller width to provide an outer tip on the leaf spring which is of a smaller width than the remaining leg portion of the leaf spring.

2. The improved retained retaining means of claim 1, wherein the outer edges of the leaf spring are rounded to eliminate sharp edges.

3. The improvement of claim 1, wherein the baton further comprises a locking means for locking the telescoping member in the extruded position and the locking means comprises a flared end on the telescoping member which wedges into a swaged end on the handle member, wherein the bowed portion of each leg of the leaf spring is adapted to engage the flared end of the telescoping member when the telescoping member is in the retracted position.

4. The improved retainer clip of claim 1, wherein the maximum space between the opposed bowed legs of the leaf spring is at a point approximately two-thirds of the distance between the base and the outer tip of the leaf spring.

* * * * *

UNITED STATES PATENT AND TRADEMARK OFFICE

CERTIFICATE OF CORRECTION

PATENT NO. : 5,161,800

DATED : November 10, 1992

INVENTOR(S) : Kevin Parsons, et al

It is certified that error appears in the above-identified patent and that said Letters Patent is hereby corrected as shown below:

CLAIM 3, Col. 4, Line 46, delete "extruded and substitute therefor ---extended---

Signed and Sealed this

Sixteenth Day of November, 1993

Bruce Lehman

*Attest:*

BRUCE LEHMAN

*Attesting Officer*

*Commissioner of Patents and Trademarks*